US010551025B2

(12) United States Patent
Millon et al.

(10) Patent No.: US 10,551,025 B2
(45) Date of Patent: Feb. 4, 2020

(54) LIGHTING DEVICE OF SMALL THICKNESS AND PRODUCING UNIFORM ILLUMINATION

(71) Applicant: Valeo Vision, Bobigny (FR)

(72) Inventors: Franck Millon, Bobigny (FR); Natacha Audy, Bobigny (FR); Lingxuan Zhu, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/128,699

(22) Filed: Sep. 12, 2018

(65) Prior Publication Data

US 2019/0078752 A1 Mar. 14, 2019

(30) Foreign Application Priority Data

Sep. 12, 2017 (FR) ..... 17 58443

(51) Int. Cl.
*F21S 43/31* (2018.01)
*F21S 43/14* (2018.01)

(52) U.S. Cl.
CPC ..... *F21S 43/31* (2018.01); *F21S 43/14* (2018.01)

(58) Field of Classification Search
CPC .. F21S 43/31; F21S 43/40; F21S 43/26; F21S 43/195; F21S 43/37; F21S 43/14; F21V 7/0083; F21Y 2115/10
See application file for complete search history.

(56) References Cited

U.S. PATENT DOCUMENTS 5,436,809 A 7/1995 Brassier et al.
7,086,765 B2 * 8/2006 Wehner ..... B60Q 1/0041 362/511
8,562,190 B2 * 10/2013 Ostrowski ..... F21S 43/13 362/507
2012/0268936 A1 * 10/2012 Pickard ..... F21K 9/90 362/249.02
2013/0329445 A1 12/2013 Oh
2016/0076720 A1 * 3/2016 Nantais ..... B60Q 1/0041 362/511
2017/0073048 A1 * 3/2017 Butcher ..... F21V 31/005

FOREIGN PATENT DOCUMENTS

EP 2 671 756 A2 12/2013
FR 2 697 485 A1 5/1994

OTHER PUBLICATIONS

French Preliminary Search Report dated Dec. 20, 2017, in French Application 1758443 filed Sep. 12, 2017 (with English Translation of Categories of Cited Documents).

* cited by examiner

*Primary Examiner* — Kevin Quarterman
(74) *Attorney, Agent, or Firm* — Oblon, McClelland, Maier & Neustadt, L.L.P.

(57) ABSTRACT

A lighting device, in particular for a motor vehicle, including a substrate; light sources of the side-emitting LED type, which are placed on the substrate and which illuminate in main directions that are orientated along the substrate; and a screen placed so as to receive the light rays emitted by the light sources. The substrate includes windows and the lighting device furthermore includes reflective surfaces that are placed facing the windows so as to reflect, toward the screen, a portion of the light rays emitted by the light sources.

19 Claims, 3 Drawing Sheets

LIGHTING DEVICE OF SMALL THICKNESS AND PRODUCING UNIFORM ILLUMINATION

The invention relates to the field of lighting and lighting signaling, in particular for motor vehicles.

Published patent document FR 2 697 485 A1 discloses a signaling light comprising a plurality of light sources of the LED (light-emitting diode) type, which are placed on a holder and which essentially illuminate perpendicular to the holder toward a scattering screen. The signaling light comprises a structure with orifices under which the LEDs are housed. The latter are here of the "Brewster" type, i.e. an outdated type with leads for mounting on a printed circuit board, said leads extending axially under the body of the LEDs. Such a mounting configuration requires a certain thickness that, in certain applications, may prove not to be available. Moreover, the LEDs illuminate directly toward the screen, thereby giving the light image produced a pixelated, or discrete, appearance.

Published patent document US 2011/0051412 A1 relates to a unit for backlighting a display screen, in particular of the liquid-crystal or plasma type. The backlighting unit comprises light sources of the side-emitting LED type. These sources are placed on a reflective substrate; the light, which is emitted mainly in the direction of the substrate, is reflected by the reflective surface of said substrate toward the back side of the display screen, with a view to backlighting it. Such an arrangement is advantageous because it increases the uniformity of the backlighting, preventing the appearance of bright spots in the locations of the light sources, in particular when they illuminate directly toward the display screen. This arrangement also allows the thickness of the backlighting unit to be decreased. It however has the drawback that the light power produced is low, essentially because a substantial amount of the light produced propagates into the unit and fails to pass through the screen.

The objective of the invention is to provide a lighting device that mitigates at least one of the drawbacks of the aforementioned prior art. More particularly, the objective of the invention is to provide a lighting device of thin construction and that produces a uniform light image.

The subject of the invention is a lighting device, in particular for a motor vehicle, comprising: a substrate; light sources of the side-emitting LED type, which are placed on the substrate and which illuminate in main directions that are orientated along the substrate; and a screen placed so as to receive the light rays emitted by the light sources; noteworthy in that the substrate comprises windows and the lighting device furthermore comprises reflective surfaces that are placed facing the windows so as to reflect, toward the screen, a portion of the light rays emitted by the light sources.

Advantageously, the screen is made of a translucent or transparent material. The screen is advantageously scattering.

Advantageously, the substrate is made of an electrically insulating material, such as FR-4, and comprises one or more printed circuits that are configured to supply the light sources with power.

Advantageously, each of the reflective surfaces is configured to reflect the portion of the light rays substantially in line with the corresponding window in a divergent beam.

Advantageously, the reflective surfaces are also scattering.

According to one advantageous embodiment of the invention, the substrate comprises two opposite main faces, the screen being placed opposite a first of said faces and the reflective surfaces being mainly placed opposite the second of said faces.

According to one advantageous embodiment of the invention, each of the light sources is adjacent to one of the windows and illuminates substantially in the direction of said window.

According to one advantageous embodiment of the invention, at least two of the light sources are respectively associated with each of the windows.

According to one advantageous embodiment of the invention, the substrate extends in a longitudinal direction, each of the windows comprising an edge extending transversely to said direction, the one or more light sources adjacent to said window being placed along said edge.

According to one advantageous embodiment of the invention, the edge of each of the windows is on a section of the substrate forming a tab. The tab thus formed is advantageous in that it frees the zone for receiving the one or more light sources from stresses related to the flexion of the substrate when the latter has, in the mounted state, a curved profile.

According to one advantageous embodiment of the invention, each of the tabs is formed by two notches of the corresponding window, on either side of the corresponding edge.

According to one advantageous embodiment of the invention, the windows are placed along the longitudinal direction and the substrate has a curved longitudinal profile.

According to one advantageous embodiment of the invention, the device comprises a holder to which the substrate and the screen are fastened, said holder comprising the reflective surfaces. This configuration is advantageous in more than one respect. Specifically it has, apart from an economic advantage, an advantage with respect to control of tolerances in the positioning of the reflective surfaces and an advantage with respect to compactness.

According to one advantageous embodiment of the invention, the holder comprises protruding sections forming the reflective surfaces and partially penetrating the windows. Advantageously, the reflective surfaces are produced by metallizing surfaces of the protruding sections. Advantageously, the holder is a single piece made of plastic.

Advantageously, the substrate is fastened to the holder, for example by screw fastening, clip fastening or staking. Advantageously, the screen is fastened to the holder, for example by clip fastening and/or by screw fastening or soldering.

According to one advantageous embodiment of the invention, each of the reflective surfaces comprises a first section that is far from the one or more corresponding light sources and a second section that is near to said one or more light sources, the second section having an average inclination with respect to the window that is greater than an average inclination of the first section with respect to said window.

According to one advantageous embodiment of the invention, each of the protruding portions comprises a step between the first and second sections of the reflective surface. The fact of providing a step is advantageous in that it makes it possible to choose which portion of the light cone emitted by the source will illuminate the first surface and which portion will illuminate the second surface: the rays coming from the source do not have the same orientation depending on the fraction of cone from which they are issued, they also do not have the same energy level.

According to one advantageous embodiment of the invention, each of the first and second sections of each of the reflective surfaces has a concave curved profile.

According to one advantageous embodiment of the invention, the device furthermore comprises a unit for controlling the light sources, which is configured in such a way that at least two of said sources receive two different light-intensity setpoints. In this case, all the light sources are not turned on with the same intensity, in particular for a photometric purpose.

According to one advantageous embodiment of the invention, the device furthermore comprises a unit for controlling the light sources, which is configured to gradually turn on the light sources one after the other in a given direction so as to modulate an area thus illuminated of the screen.

According to one advantageous embodiment of the invention, the controlling unit is configured to also gradually turn off, one after the other, the light sources located at an end of the illuminated area that is opposite, in the given direction, to the light sources turned on one by one, so as to move the area thus illuminated of the screen.

The measures of the invention are advantageous in that they make it possible to produce a lighting device of small thickness with a high light uniformity in the produced light image. They also allow a curved or cambered lighting device to be produced, and this to be done economically by means in particular of a substrate that is initially flat and that is able to be bent when it is fastened to the holder. The production of a very uniform light image also has the advantage of making it possible to modulate the area of the light image continuously and gradually. Via such a modulation, information may be expressed. It may be a question of operating conditions of the vehicle, such as for example the fact that it is accelerating or decelerating.

Other features and advantages of the present invention will be better understood by virtue of the description and the drawings, in which:

FIGS. 1 and 2 illustrate in perspective and exploded, respectively, a lighting device according to the invention.

Figure 1:
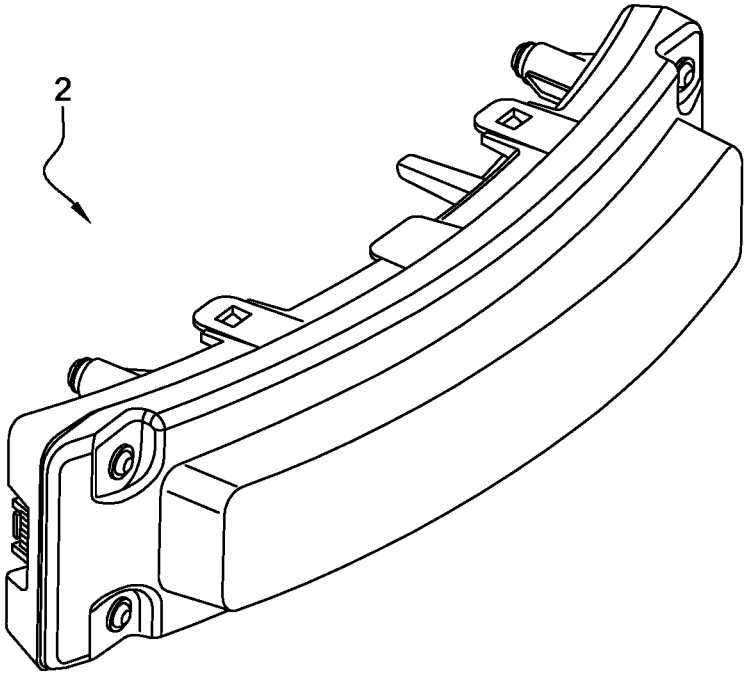
FIG. 1 is a perspective representation of a lighting device according to the invention.

The lighting device 2 essentially consists of a substrate 4 provided with windows 6, light sources 8 of the LED (light-emitting diode) type, which light sources are placed, adjacent to the windows 6, on the substrate 4, a holder 10, and a screen 12, the latter being placed opposite the substrate 4 and the light sources 8.

The holder 10 is advantageously made of plastic by injection moulding. It comprises a main section 10.1 extending along the device and a series of sections 10.2 that protrude from the main section 10.1. Reflective surfaces 14 are formed on these protruding sections 10.2, these sections possibly being intended to penetrate, at least partially, the windows 6 formed in the substrate 4. The reflective surfaces may be produced by metallization of the protruding sections 10.2.

The light sources 8 are side-emitting LEDs (commonly known as "sideleds"), such as for example the model LSA67F from Osram®. Such LEDs illuminate along a main axis that is transverse, and preferably perpendicular, to the plane of mounting on the substrate. These LEDs illuminate in a cone centred on the main axis and possibly making an angle of about 60° with said axis, corresponding to an apex angle of the cone of about 120°, the light intensity being maximum on the main axis and higher than or equal to 50% of said maximum value at the limits of the cone in question. The light sources 8 are thus configured to illuminate laterally toward the windows 6 to which they are adjacent, respectively, and, therefore, toward the corresponding reflective surfaces 14. One portion of the light flux emitted by each light source is thus reflected by the corresponding reflective surface, toward the screen 12; another portion of the light flux being directed directly from the source to the screen 12. Details on the paths of the rays emitted by the light sources are given below with reference to FIG. 4.

The substrate 4 is advantageously made of electrically insulating material on which one or more printed circuits are formed, with a view to supplying the light sources 8 with power. The printed circuits are not shown but are well known per se to those skilled in the art. To this end, a connector 16 may be placed on the substrate 4, and electrically connected to the printed circuits and thus to the light sources 8. The substrate is advantageously made of an epoxy resin reinforced with glass fibres, such as for example FR-4 (FR being the acronym for "Flame Resistant"), which is commonly used in the boards of printed-circuit board. The substrate in question advantageously has a small thickness, smaller than or equal to 1.6 mm, so as to be able to be curved as may be seen in FIG. 2. The presence of the windows 6 in the substrate 4 makes the latter easier to bend in that they decrease its stiffness and therefore the forces that must be applied where it is fastened to the holder 10, to keep it in the curved state.

The screen 12 is made of translucent or transparent material, such as in particular of PMMA (polymethyl methacrylate). It is advantageously produced by injection moulding. It may comprise means for fastening it to the holder 10, such as in particular clipping tabs 12.1 and/or zones 12.2 for receiving screws.

Figure 2:
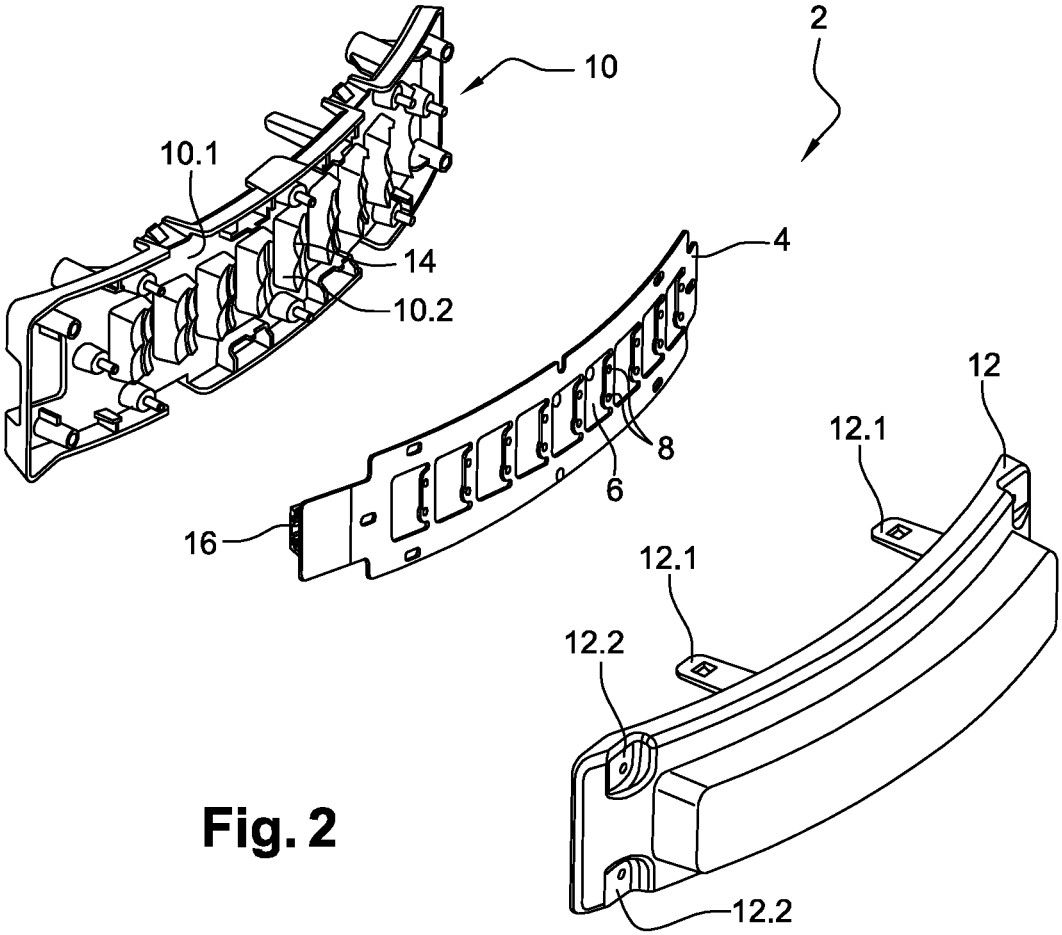
FIG. 2 is an exploded representation of the lighting device of FIG. 1.
Figure 3:
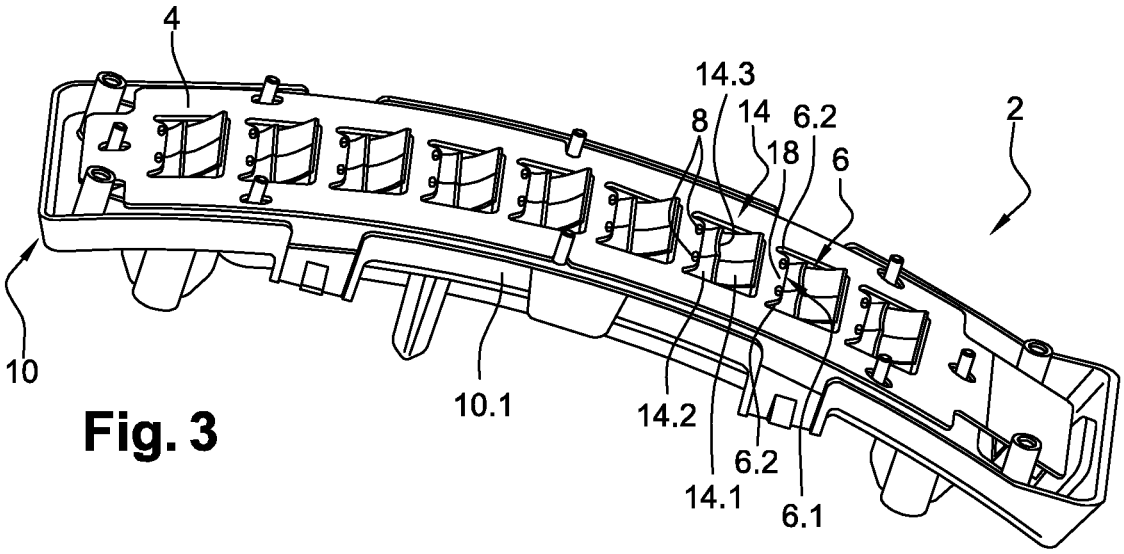
FIG. 3 is a representation from another perspective of the lighting device of FIGS. 1 and 2, the device being without the scattering screen.

FIG. 3 is another perspective view of a lighting device of FIGS. 1 and 2, in which the screen is absent.

The positioning of the reflective surfaces 14 opposite each of the windows 6 in the substrate 4 may be seen. More specifically, it is possible to observe, in the present case, that two light sources 8 are associated with each of the windows 6. It will however be understood that this number may be different, namely that a single light source or even more than two light sources may be associated with each of the windows. The light sources 8 of each window 6 are placed along an edge 6.1 of the window. This edge 6.1 is advantageously rectilinear. It advantageously extends transversely, and preferably perpendicular, to a longitudinal axis of the device 2. Each window 6 advantageously has a polygonal shape, the edge 6.1 forming one side thereof. In the present case, the windows 6 have a generally rectangular shape, it being understood that other shapes are envisageable. It may also be seen that the light sources 8 are placed on a tab 18 formed by a section of the substrate 4 and by two notches 6.2 of the window 6, on either side of the edge 6.1. These notches thus advantageously extend along the longitudinal axis of the device. This configuration is particularly advantageous when the substrate is subjected to a flexural stress, as is the case in the present exemplary embodiment. Specifically, these tabs are free of the flexural stresses applied to the substrate, thus preventing stresses from being applied to the fastening and connection of light sources to the substrate, and to the body of these sources themselves. The light sources are placed along the edge 6.1 so as to mainly illuminate in the direction of the corresponding window 6, i.e. the window comprising said edge 6.1.

Again in FIG. 3, it may be seen that the protruding sections 14.2 of the holder 14 partially penetrate the windows 6, respectively. It may also be seen that the reflective surfaces 14 are inclined with respect to the windows so that the amount by which said surfaces protrude from the windows increases with the longitudinal distance from the associated light sources. It may moreover also be seen that each of the reflective surfaces 14 may be subdivided into two sections, namely a first section 14.1 that is far from the light sources 8 and a second section 14.2 that is near to said sources. These two sections 14.1 and 14.2 are advantageously connected by a step 14.3. Similarly, each of the light surfaces 14 or of the first and second sections 14.1 and 14.2 of the light surfaces 14 may be subdivided longitudinally between two sections, each of said sections being associated with one of the two light sources 8.

Figure 4:
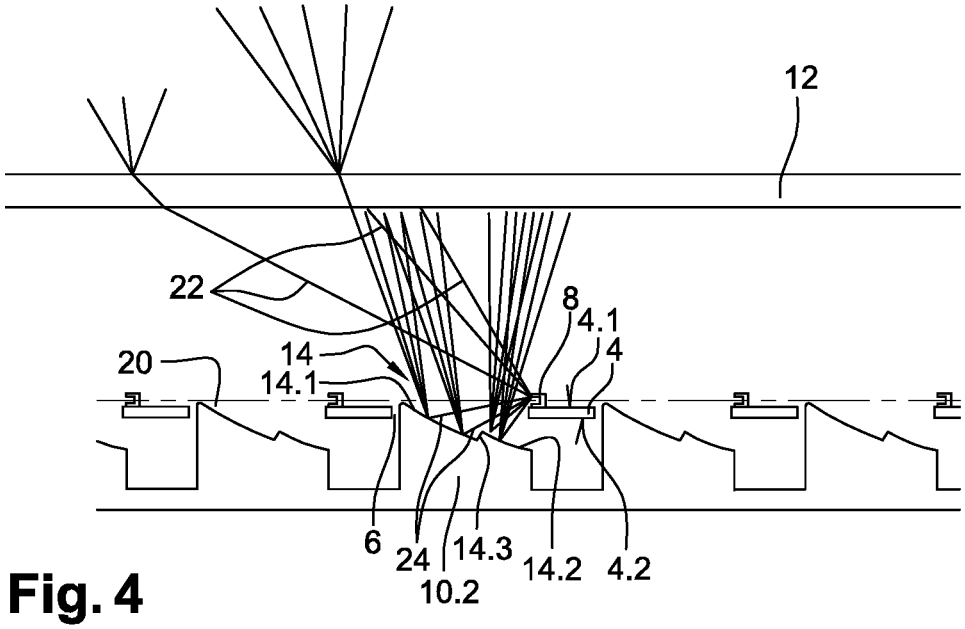
FIG. 4 is a schematic cross-sectional representation of the device of FIGS. 1 to 3, illustrating the paths of the light rays.

FIG. 4 is a schematic longitudinal cross-sectional view of the device of FIGS. 1 to 3, the cross section passing through one of the light sources 8. The paths of the light rays emitted by one of the light sources 8 shown may be seen therein, it being understood that these paths also apply to the other light sources. The substrate 4, the holder 10 and the screen 12 have been shown rectilinear therein for the sake of clarity of the description, it being understood that the described principles also apply to a curved or cambered configuration, such as in the device of FIGS. 1 to 3.

It may be seen in FIG. 4 that the main axis 20 of illumination of the light sources is parallel to the windows, in the present case to the substrate (in so far as the latter is flat in the illustrated embodiment). The light source 8 thus illuminates in this direction toward the corresponding window 6. The substrate 4 has a first face 4.1 opposite the screen 12 and a second face 4.2 opposite the first. Among the emitted rays, the rays 22 emitted in the direction of the screen 12 are refracted and transmitted by the screen 12. In contrast, the rays 24 emitted through the window 6 are reflected by the reflective surface 14 that is located opposite said window 6. More specifically, the rays that encounter the reflective-surface section 14.1 that is far from the light source 8 are reflected toward the left of the window 6 whereas the rays that meet the reflective-surface section 14.2 that is near the light source 8 are reflected toward the right of the window 6. It will be understood that these directions may be different in another embodiment. It may moreover be seen that the step 14.3 between the two reflective-surface sections 14.1 and 14.2 allow the second section 14.2 to be raised or elevated with respect to the first section 14.1. This elevation provides the second section 14.2, level with the step 14.3, with an inclination, with respect to the plane of the window, that is larger than that of the first section 14.1 level with said step 14.3. The rays incident on the second section 14.2 are thus reflected more toward the right. The construction of the reflective surface 14 that has just been described thus broadens the reflected light beam, this participating in increasing the uniformity of the light image emitted by the screen 12. Although this is not shown in FIG. 4, with a view to avoiding overly cluttering the schematic representation, the rays emitted by neighbouring light sources directly toward the screen section illuminated by the light beam reflected by the reflective surface 14, namely the neighbouring light sources located to the right, will complement the beam in question. As a result, a very good uniformity is obtained, despite the use of discrete light sources and the absence of optical light guide.

It will be noted that the particular construction of the reflective surface 14 that has just been described above may be replaced with other reflective surface profiles while obtaining the same effect of spreading the reflected beam. Specifically, it is envisageable to provide a profile without a step but with variable radii of curvature. It is also envisageable to subdivide the reflective surface into more sections, longitudinally and/or transversely.

Again with reference to FIG. 4, the reflective surfaces 14 may have scattering properties in order to scatter the rays reflected by said surfaces. Similarly, the screen 12 is advantageously scattering; in particular, at least one of its faces (advantageously the exit face) may have a certain roughness, and/or the translucent or transparent material from which it is made may contain a scattering filler material.

Figure 5:
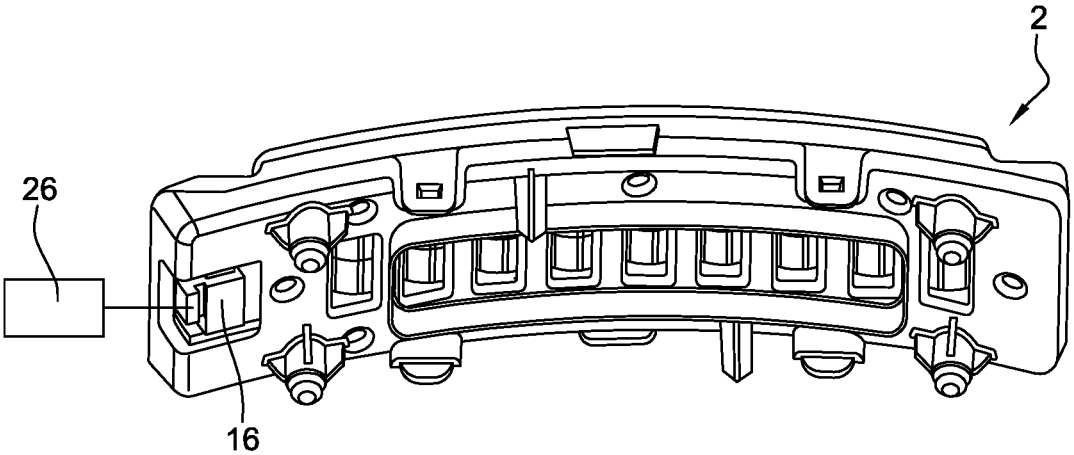
FIG. 5 is a rear view of the lighting device of FIGS. 1 to 3, the device being electrically connected to a controlling unit.

FIG. 5 illustrates in perspective the lighting device 2 of FIGS. 1 to 3, electrically connected, via the connector 16, to a unit 26 for controlling the light sources of said device. The light sources of the device may all be connected together, so that they can be turned on only all at the same time. Alternatively, it is envisageable to make provision for independent power-supply zones, in particular along the longitudinal direction of the device. In the present case, the light sources associated with each window may be supplied with power independently from the other light sources.

Such a configuration is advantageous in that it allows the illuminated area of the screen to be gradually varied in a way that creates a continuity effect because of the particular uniform character of the illumination produced. Such a configuration is also advantageous for static illumination, essentially in that it allows various light sources to be supplied with different electrical currents, in particular for photometric purposes.

Figure 6:
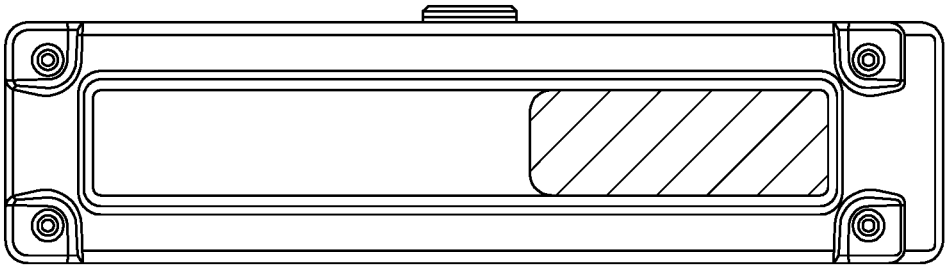
FIGS. 6 to 8 illustrate dynamic light images produced by the lighting device of FIGS. 1 to 3 and 5.
Figure 7:
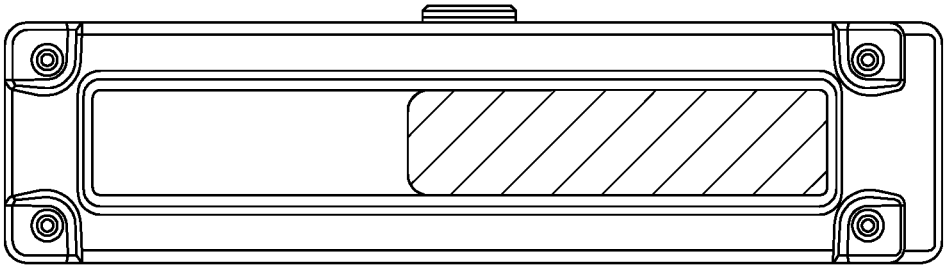
Figure 8:
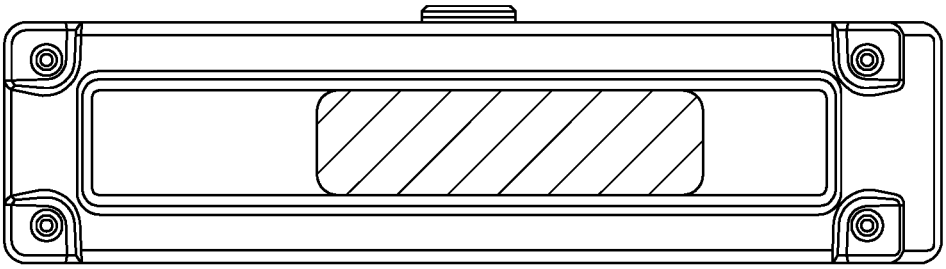

FIGS. 6 to 8 illustrate an example of variation of the illuminated area of the screen of the device of FIGS. 1 to 3 and 5. In FIG. 6 it may be seen that a right-hand section of the screen is illuminated. The controlling unit 26 (FIG. 5) allows the number of light sources supplied with power to be gradually increased, thus increasing the extent of the illuminated area of the screen, as may be seen in FIG. 7. With reference to FIG. 8, it is also possible to make provision to gradually stop the supply of power to the light sources, in particular opposite to the light sources that are gradually supplied with power, so as to "move" the illuminated area. Such a modulation or such a movement is advantageous in combination with a very uniform illumination of the screen because it may give an impression similar to that of a liquid the limits of which are in motion.

The invention claimed is:

1. A lighting device for a motor vehicle, comprising:

a substrate having openings;

light sources arranged on a first surface of the substrate, the light sources being side-emitting light sources configured to illuminate in main directions orientated along the substrate; and a screen offset from the first surface of the substrate so as to receive light rays emitted by the light sources, wherein the openings of the substrate are formed from the first surface of the substrate to a second surface of the substrate, the second surface of the substrate being opposite the first surface of the substrate, and reflective surfaces, disposed from the second surface of the substrate and at least partially through the openings of the substrate, reflect, toward the screen, a portion of the light rays emitted by the light sources.

2. The lighting device according to claim 1, wherein at least one light source of the light sources is adjacent one of the openings and illuminates substantially in a direction of the adjacent one of the openings.

3. The lighting device according to claim 2, wherein two or more of the at least one light source of the light sources are respectively associated with each of the openings.

4. The lighting device according to claim 2, wherein the substrate extends in a longitudinal direction, each of the openings comprising an edge extending transversely to the longitudinal direction of the substrate, the at least one light source of the light sources adjacent the one of the openings being arranged along the edge.

5. The lighting device according to claim 4, wherein the edge of each of the openings defines a section of the substrate forming a tab.

6. The lighting device according to claim 5, wherein each tab of the substrate is formed by two notches on either side of a corresponding edge of a corresponding opening.

7. The lighting device according to claim 4, wherein the openings are disposed along the longitudinal direction of the substrate and the substrate is curved along the longitudinal direction.

8. The lighting device according to claim 1, further comprising a holder to which the substrate and the screen are fastened.

9. The lighting device according to claim 8, wherein the holder includes protruding sections forming the reflective surfaces disposed at least partially through the openings of the substrate.

10. The lighting device according to claim 1, wherein each of the reflective surfaces comprises a first section located further from a corresponding light source of the light sources than a second section, a surface of the second section having an average inclination, relative to a plane of a corresponding opening, that is greater than an average inclination of a surface of the first section relative to the plane of the corresponding opening.

11. The lighting device according to claim 10, wherein, for each of the reflective surfaces, the first section is offset from the second section by a step defining a distance in a direction perpendicular to the plane of the corresponding opening.

12. The lighting device according to claim 10, wherein the surface of the first section and the surface of the second section of each of the reflective surfaces is concave.

13. The lighting device according to claim 1, further comprising processing circuitry configured to control the light sources such that at least two of the light sources have different light-intensity set points.

14. The lighting device according to claim 1, further comprising processing circuitry configured to control the light sources in order to sequentially turn on the light sources, from a first end of the substrate and along a longitudinal direction of the substrate, so as to modulate an illuminated area of the screen.

15. The lighting device according to claim 14, wherein the processing circuitry is further configured to control the light sources in order to sequentially turn off the light sources from the first end and along the longitudinal direction of the substrate, the light sources being sequentially turned off following a pre-determined period of time of illumination, the control of the light sources thereby moving the illuminated area of the screen.

16. The lighting device according to claim 1, wherein each of the light sources is adjacent one of the openings and illuminates substantially in a direction of the adjacent one of the openings.

17. The lighting device according to claim 3, wherein the substrate extends in a longitudinal direction, each of the openings comprising an edge extending transversely to the longitudinal direction of the substrate, the at least one light source of the light sources adjacent each opening being arranged along the edge.

18. The lighting device according to claim 17, wherein the openings are disposed along the longitudinal direction of the substrate and the substrate is curved along the longitudinal direction of the substrate.

19. The lighting device according to claim 1, wherein a portion of the light rays emitted by the light sources is directed directly to the screen.

* * * * *